US007254346B2

(12) United States Patent
Burchette et al.

(10) Patent No.: US 7,254,346 B2
(45) **Date of Patent: *Aug. 7, 2007**

(54) SYSTEMS AND METHODS FOR UNIVERSAL IMAGING COMPONENTS

(75) Inventors: Lynton R. Burchette, Sanford, NC (US); William Eli Thacker, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/475,410

(22) Filed: Jun. 27, 2006

(65) Prior Publication Data

US 2006/0245767 A1 Nov. 2, 2006

Related U.S. Application Data

(63) Continuation of application No. 10/918,166, filed on Aug. 13, 2004, now Pat. No. 7,088,928.

(51) Int. Cl.
*G03G 15/00* (2006.01)

(52) U.S. Cl. ..... 399/12; 399/25; 399/82

(58) Field of Classification Search ..... 399/12, 399/13, 9, 111, 24, 25, 26, 27, 82; 347/19, 347/86

See application file for complete search history.

(56) References Cited

U.S. PATENT DOCUMENTS

| | | | | |
|---|---|---|---|---|
| 5,235,384 | A * | 8/1993 | Oka et al. | 399/27 |
| 6,104,888 | A | 8/2000 | Kobayashi | |
| 6,181,885 | B1 | 1/2001 | Best et al. | |
| 6,339,684 | B1 * | 1/2002 | Sato et al. | 399/12 |
| 6,904,248 | B2 | 6/2005 | Daniels | |
| 7,088,928 | B2 * | 8/2006 | Burchette et al. | 399/12 |
| 7,136,608 | B2 | 11/2006 | Miller | |
| 7,187,874 | B1 | 3/2007 | Miller | |
| 2004/0212651 | A1 * | 10/2004 | Johnson et al. | 347/19 |

FOREIGN PATENT DOCUMENTS

| | | | |
|---|---|---|---|
| JP | 04-070675 | A * | 3/1992 |
| JP | 2003-084631 | | 3/2003 |

* cited by examiner

*Primary Examiner*—Sophia S. Chen

(57) ABSTRACT

A cartridge chip for use with an imaging cartridge installed in an imaging device, the cartridge chip including a memory element storing imaging cartridge data, and a controller for controlling the operation of the cartridge chip and determining if the imaging device is a first type of imaging device or a second type of imaging device, the controller for operating the cartridge chip in a first mode of operation if the imaging device is the first type of imaging device, the controller for operating the cartridge chip in a second mode of operation if the imaging device is the second type of imaging device.

16 Claims, 5 Drawing Sheets

FIG. 4

400

| ADDRESS | DATA |
|---|---|
| 00 | 3fd52ce5 |
| 01 | a9744127 |
| 02 | 0019d63b |
| 03 | f2b3ce8f |
| 04 | 68bd2faf |
| 05 | 6bab6bab |
| 06 | a7a7a7a7 |
| 07 | e3a3e3a3 |
| 08 | 6c901c9f |
| 09 | f02e6a71 |
| 0a | 9497149f |
| 0b | e6868a2e |
| 0c | 00007ca7 |
| 0d | 489769aa |
| 0e | 8955859b |
| 0f | b18cfdbf |
| 10 | 3aff3aff |
| 11 | 7efb7efb |
| 12 | b2f7b2f7 |
| 13 | f6f3f6f3 |
| 14 | 2bef2bef |
| 15 | 6feb6feb |
| 16 | a3e7a3e7 |
| 17 | e7e3e7e3 |
| 18 | 18df18df |
| 19 | 5cdb5cdb |
| 1a | 884f90d7 |
| 1b | d4d3d4d3 |
| 1c | 09cf1157 |
| 1d | 4dcb4dcb |
| 1e | 440d4e8e |
| 1f | 48502020 |
| 20 | 20202020 |
| 21 | 73330001 |
| 22 | bf3fbe37 |

FIG. 5

500

| ADDRESS | DATA |
|---|---|
| 00 | 3fd51344 |
| 01 | 061b7be7 |
| 02 | 00190214 |
| 03 | 72b11c07 |
| 04 | 93916cad |
| 05 | d79528a9 |
| 06 | 4910e4a5 |
| 07 | 06ad7d81 |
| 08 | 4a8e039c |
| 09 | 0e8a075c |
| 0a | 82820c27 |
| 0b | 13590ab7 |
| 0c | 4e8dcf95 |
| 0d | 479336f4 |
| 0e | 000003b1 |
| 0f | ffffe864 |
| 10 | b1f43551 |
| 11 | 5b3c4756 |
| 12 | e5631e07 |
| 13 | 386416aa |
| 14 | 70751e24 |
| 15 | 2ce92ce9 |
| 16 | 962ce0e5 |
| 17 | b0774b13 |
| 18 | d648f886 |
| 19 | 07416910 |
| 1a | d3d5d3d5 |
| 1b | e11897d1 |
| 1c | 9a00da01 |
| 1d | 0ec90001 |
| 1e | 48502020 |
| 1f | 20202020 |
| 20 | 753d753d |
| 21 | 31393139 |
| 22 | fd35fd35 |

SYSTEMS AND METHODS FOR UNIVERSAL IMAGING COMPONENTS

The present application is a continuation of allowed U.S. patent application Ser. No. 10/918,166 filed on Aug. 13, 2004 now U.S. Pat. No. 7,088,928 which is incorporated by reference herein in its entirety.

BACKGROUND

The present invention generally relates to manufacturing or remanufacturing repairing replaceable imaging components, and more particularly to techniques for providing universal cartridge chip including a memory element adapted for use in multiple types of imaging cartridges.

In the imaging industry, there is a growing market for the remanufacture and refurbishing of various types of replaceable imaging cartridges such as toner cartridges, drum cartridges, inkjet cartridges, and the like. Imaging cartridges, once spent, are unusable for their originally intended purpose. Without a refurbishing process, they would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the cartridge.

Some imaging cartridges may include a cartridge chip having a memory device which is used to store data related to the cartridge or the imaging device. An imaging device may include laser printers, copiers, inkjet printers, facsimile machines and the like, for example. The imaging device, such as the printer, reads the data stored in the cartridge memory device to determine certain printing parameters and communicates information to the user. For example, the memory may store the model number of the imaging cartridge so that the printer may recognize the imaging cartridge as one which is compatible with that particular imaging device. Additionally, by way of example, the cartridge memory may store the number of pages that can be expected to be printed from the imaging cartridge during a life cycle of the imaging cartridge and other useful data. The imaging device may also write certain data to the memory device, such as an indication of the amount of toner remaining in the cartridge. Other data stored in the memory device may relate to the usage history of the toner cartridge.

Typically, each type of imaging cartridge, such as a toner cartridge, requires a different type of cartridge chip. While necessary to the proper operation of the imaging device, the differences between certain types of chip cartridges may be subtle or slight. With the ever increasing number of types and models of imaging devices and imaging cartridges being sold, remanufacturers must stock an increasing number of types of cartridge chips, with each type of cartridge chip usable with only a single type of imaging cartridge. It would be advantageous to provide systems and methods for a universal cartridge chip which operates with more than one type or model of imaging cartridge, and thus in more than one type or model of printer. Additionally, it would be advantageous to provide systems and methods for a universal cartridge chip which allows one type of imaging cartridge to be used in multiple types of imaging devices. Furthermore, it would be advantageous to provide systems and methods for a universal cartridge chip that allows remanufacturers of imaging cartridges to reduce the number of types of cartridge chips stored in their inventory.

SUMMARY

In one aspect of the present invention a method of operating an imaging cartridge installed in an imaging device is provided. The imaging cartridge includes a cartridge chip. The method includes determining, by the cartridge chip, if the imaging device is a first type of imaging device or a second type of imaging device; operating the cartridge chip in a first mode of operation if the imaging device is the first type of imaging device; and operating the cartridge chip in a second mode of operation if the imaging device is the second type of imaging device.

A cartridge chip for use with an imaging cartridge installed in an imaging device may include a memory element storing imaging cartridge data, and a controller for controlling the operation of the cartridge chip and determining if the imaging device is a first type of imaging device or a second type of imaging device, said controller for operating the cartridge chip in a first mode of operation if the imaging device is the first type of imaging device, said controller for operating the cartridge chip in a second mode of operation if the imaging device is the second type of imaging device.

A more complete understanding of the present invention, as well as further features and advantages of the invention, will be apparent from the following detailed description and the accompanying drawings.

BRIEF DESCRIPTION OF THE DRAWINGS

FIG. 4 shows an exemplary partial memory map for a universal cartridge chip compatible with an HP 9000 printer in accordance with the present invention;

FIG. 5 shows an exemplary partial memory map for a universal cartridge chip compatible with an HP 9500 printer in accordance with the present invention;

DETAILED DESCRIPTION

The following detailed description of preferred embodiments refers to the accompanying drawings which illustrate specific embodiments of the invention. In the discussion that follows, specific systems and techniques for repairing, manufacturing or remanufacturing a toner cartridge comprising a cartridge chip including a memory element are disclosed. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

Figure 1:
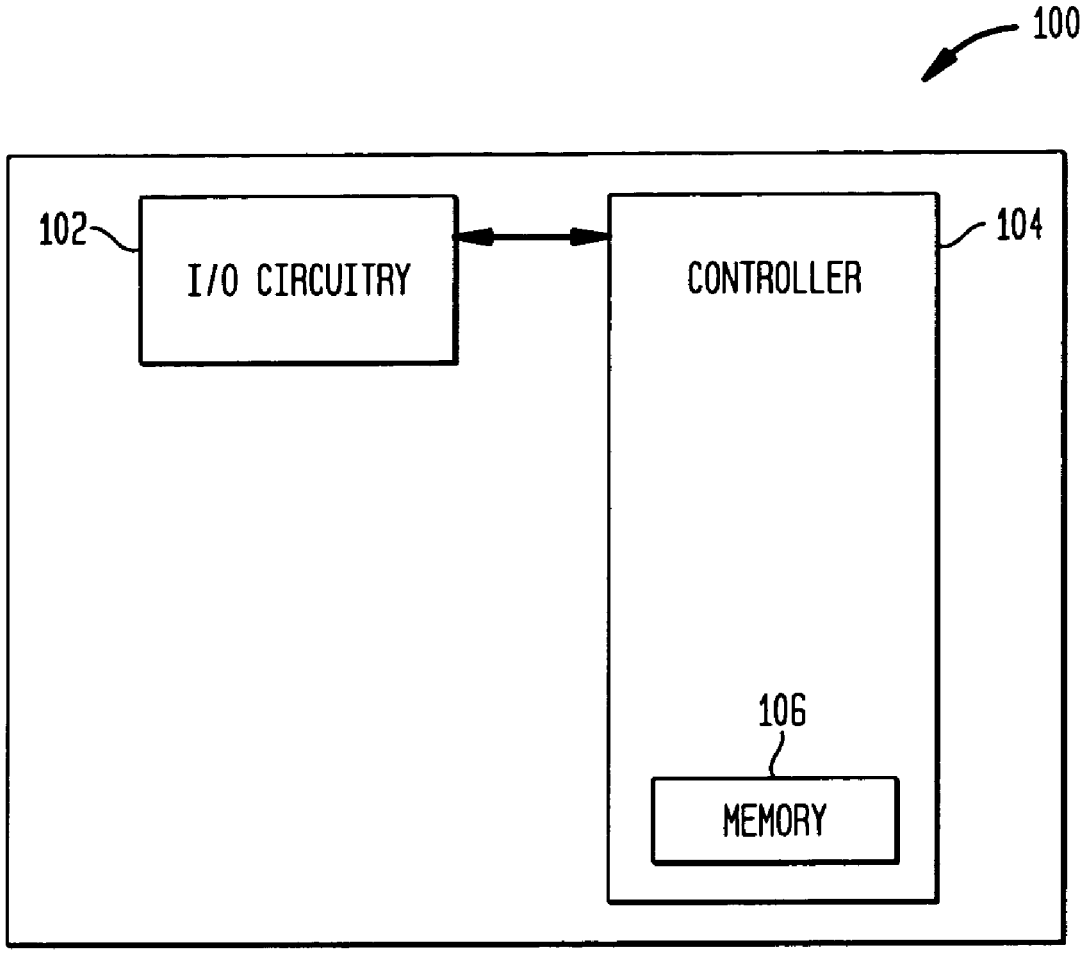
FIG. 1 shows a functional block diagram of a universal cartridge chip in accordance with the present invention.

FIG. 1 shows a functional block diagram of a universal cartridge chip 100 in accordance with the present invention. The universal cartridge chip 100 may suitably include input/output (I/O) interface circuitry 102, a controller 104, and a memory 106. The I/O interface circuitry 102 is communicatively connected to the controller 104 and provides the appropriate electronic circuitry for the controller 104 to communicate with an imaging device, such as a printer. As an example, for imaging devices which communicate utilizing radio frequency (RF), the I/O interface circuitry 102 may include a radio frequency (RF) antenna and circuitry, and for a direct wired connection to imaging devices the I/O interface circuitry 102 may include one or more contact pads, or the like.

As described in greater detail below, the controller 104 controls the operation of the universal cartridge chip 100 and provides a functional interface to the memory 106, including controlling the reading of data from and the writing of data to the memory 106 by the printer. The data read from or written to the universal cartridge chip 100 may include a printer type, cartridge serial number, the number of revolutions performed by the organic photo conductor (OPC) drum (drum count), the manufacturing date, number of pages printed (page count), percentage of toner remaining, yield (expected number of pages), color indicator, toner-out indicator, toner low indicator, virgin cartridge indicator (whether or not the cartridge has been remanufactured before), job count (number of pages printed and page type), and any other data or program instructions that may be stored on the memory 106.

Figure 2:
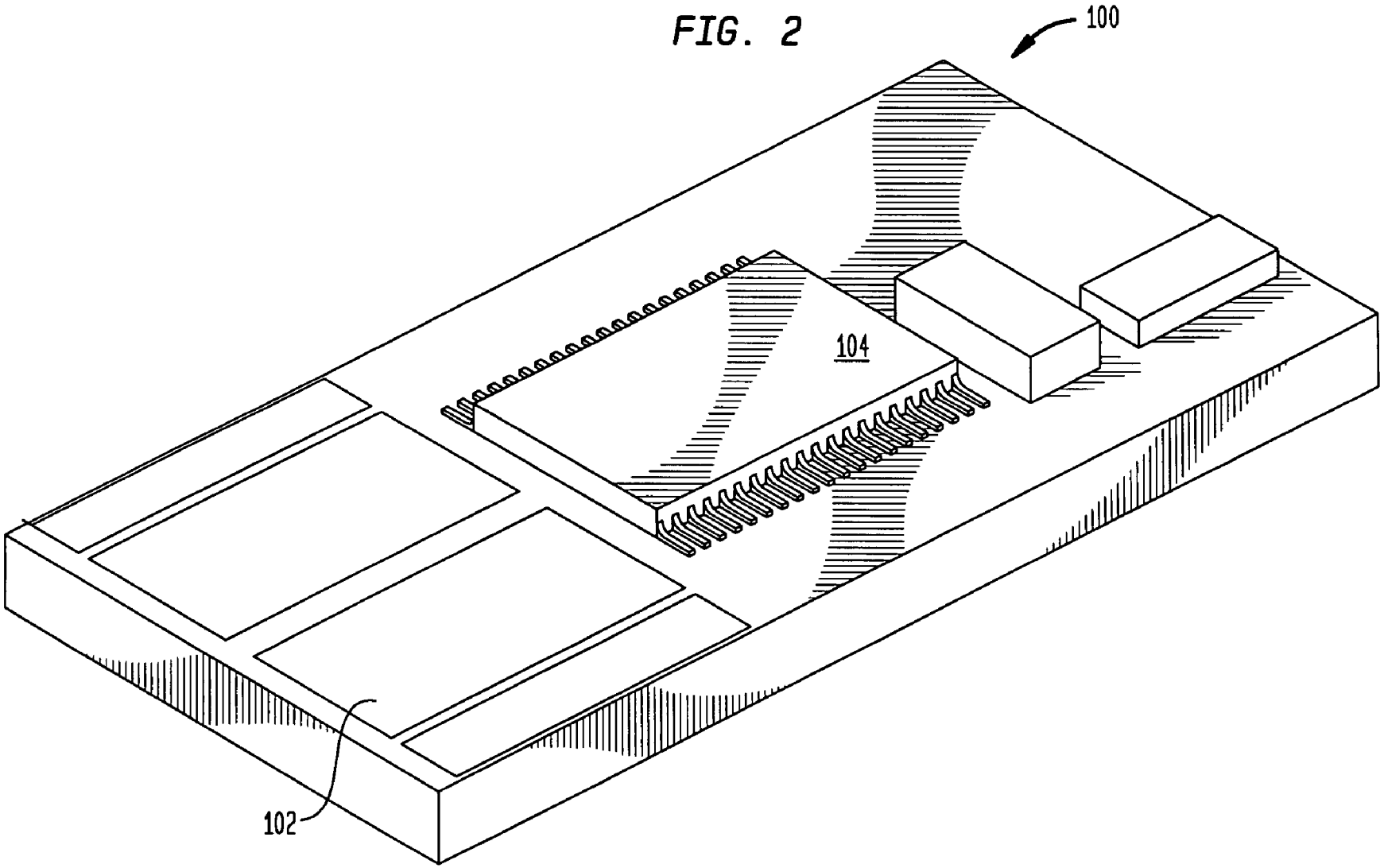
FIG. 2 shows a perspective view of a universal cartridge chip in accordance with the present invention.
Figure 3:
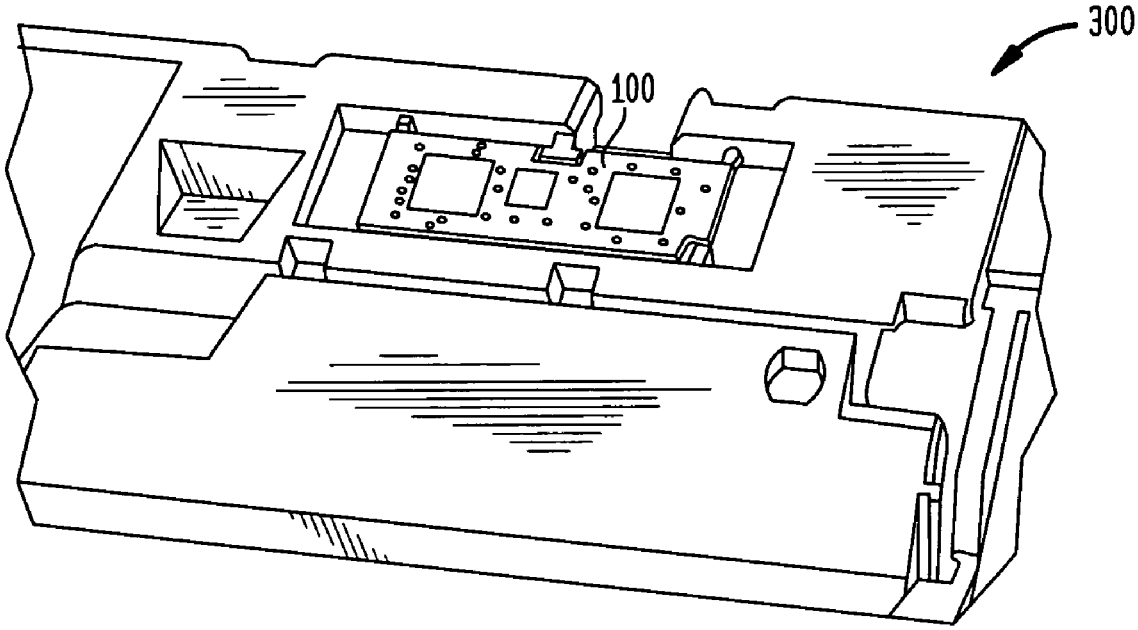
FIG. 3 shows a perspective view of a universal cartridge chip installed on an imaging cartridge in accordance with the present invention.

The controller 104 may be suitably implemented as a custom or semi-custom integrated circuit, a programmable gate array, a microprocessor executing instructions from the memory 106 or other memory, a microcontroller, or the like. Additionally, the controller 104, the memory 106 and/or the I/O interface circuitry 102 may be separated or combined in one or more physical modules. These modules may be suitably mounted to a printed circuit board to form the universal cartridge chip 100. For example, the controller may be suitably implemented in a PICmicro® microcontroller manufactured by Microchip Technology Inc. FIG. 2 shows a perspective view of one embodiment of the universal cartridge chip 100 in accordance with the present invention. FIG. 3 shows a perspective view of another embodiment of the universal cartridge chip 100 installed on an exemplary imaging cartridge 300 in accordance with the present invention.

Different printer types, or printer models, may communicate or interface with in different ways with the cartridge chips installed on toner cartridges. Additionally, different printer types may expect differing data to be stored in the cartridge chip or utilize the stored data in different ways. When installed in or attached to an imaging cartridge which is installed in an imaging device, the universal cartridge chip 100 of the present invention determines if the imaging device is a first type of imaging device or a second type of imaging device. If the universal cartridge chip 100 determines that the imaging device is the first type of imaging device, the universal cartridge chip 100 operates in a first mode of operation compatible with the first type of imaging device. If the universal cartridge chip 100 determines that the imaging device is the second type of imaging device, the universal cartridge chip operates in a second mode of operation compatible with the second type of imaging device.

As an example, while the HP 9000 printer and the HP 9500 printer both transmit an identification number to the universal cartridge chip 100 after a toner cartridge has been installed in the printer, each of these two types of printers transmits a different identification number. The HP 9000 printer transmits "2CE5A974" to the toner cartridge as the identification number. In contrast, the HP 9500 printer transmits "1344061B" to the black toner cartridge as the identification number. Note that the identification number and the following data are represented in hexadecimal notation. The controller 104 of the universal cartridge chip 100 may suitably monitor this data sent from the printer to determine whether the printer is an HP 9000 printer or an HP 9500 printer. The controller 104 may determine the type or family of the imaging device in which the universal cartridge chip 100 is installed. The controller 104 will then respond to and interoperate with the imaging device in a particular manner based on this determination. The controller 104 may cause the universal cartridge chip 100 to emulate the particular type of cartridge chip expected by the imaging device. Based on the determination of the printer type, the controller 104 will interoperate with the printer in a particular mode of operation compatible with that printer. For example, if the universal cartridge chip 100 determines the printer is an HP 9000, the controller 104 may present the memory map 400 shown in FIG. 4 to the printer when the printer reads from the memory 106. If the universal cartridge chip 100 determines the printer is an HP 9500 utilizing a black toner cartridge, the controller 104 may present the memory map 500 shown in FIG. 5 to the printer when the printer reads from the memory 106.

As another example, both the HP 4600 printer and the HP 4650 printer are capable of operating with the same toner cartridge, yet these printers operate on data read from the cartridge chip attached to the toner cartridge in different ways, and thus it may be desirable to return different data to each printer when the printer reads from the memory 106. According to an embodiment of the present invention, the universal cartridge chip 100 operates appropriately with either the HP 4600 printer or the HP 4650 printer. The universal cartridge chip 100, when attached to a toner cartridge installed in a printer, determines if the printer is a first type of imaging device, such as the HP 4600 printer, or a second type of imaging device, such as the HP 4650 printer, and then operates in different ways based on the type of imaging device detected. If the universal cartridge chip 100 determines that the printer is an HP 4600, the universal cartridge chip 100 will operate in a first mode of operation compatible with the HP 4600 printer. For example, in the first mode of operation the universal cartridge chip 100 may return a first value to the HP 4600 printer when the printer performs a read of a predetermined memory location. If the universal cartridge chip 100 determines that the printer is an HP 4650, the universal cartridge chip 100 will operate in a second mode of operation compatible with the HP 4600 printer. For example, in the second mode of operation the universal cartridge chip 100 will return a second value, different from the first value, to the HP 4650 printer when the printer performs a read of the predetermined memory location. The printers may require these different first and second values to operate in a desired fashion. Thus, a single toner cartridge using the universal cartridge chip 100 may be used in either the HP 4600 printer or the HP 4650 printer.

Figure 6:
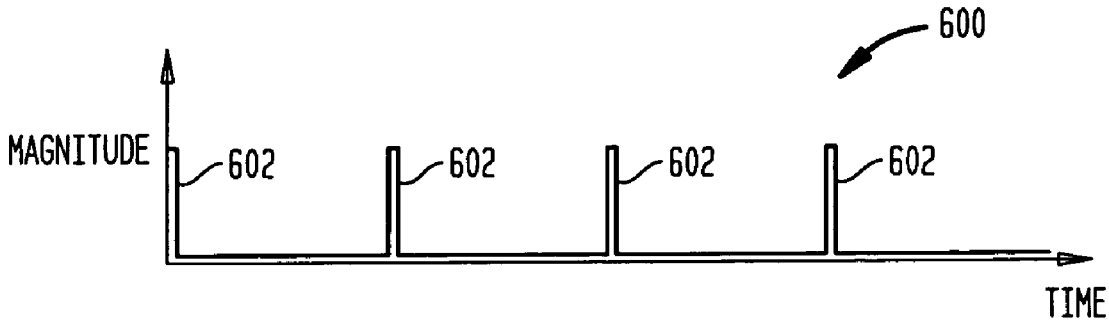
FIG. 6 shows an exemplary imaging cartridge communication timing diagram for a first type of printer.
Figure 7:
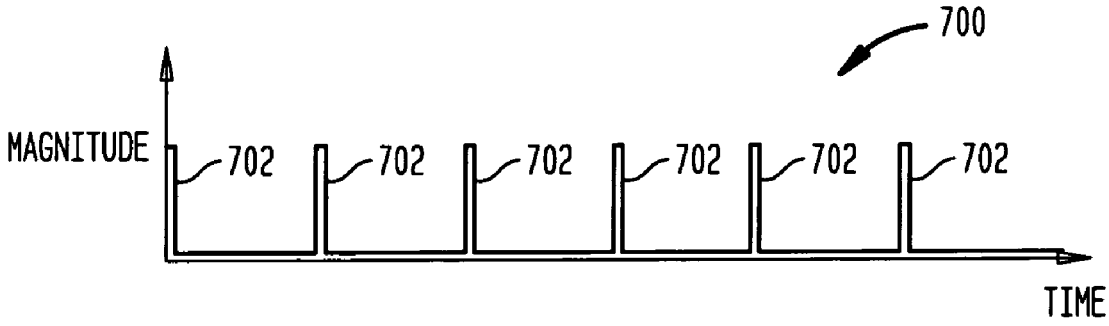
FIG. 7 shows an exemplary imaging cartridge communication timing diagram for a second type of printer.

To determine the model or type of an imaging device, the universal cartridge chip 100 may use a variety of techniques depending on the specifics of how various imaging devices operate. For example, as described above, the identification number transmitted from the printer may be used to determine the printer type or model. For the HP 4600 and HP 4650 printers, the timing of the signals transmitted from the printer to the universal cartridge chip 100 differs between the HP 4600 printer and the HP 4650 printer. FIG. 6 shows an exemplary communication timing diagram of a communication signal 600 transmitted from the HP 4600 printer to the universal cartridge chip 100. The communication signal 600 for the HP 4600 printer comprises a plurality of data transfers 602. FIG. 7 shows an exemplary communication timing diagram of a communication signal 700 transmitted from the HP 4650 printer to the universal cartridge chip 100. The communication signal 700 for the HP 4600 printer comprises a plurality of data transfers 702. Each of these data transfers 602 and 702 may suitably comprise four or more bytes of data. As shown in these figures, the timing of the printer to cartridge chip communication differs between these two printers in that the data transfers 602 are separated by a greater period of time when compared to the data transfers 702. In other words, while operating in a similar fashion, the HP 4650 communicates faster that the HP 4600. The controller 104 of the universal cartridge chip 100 may monitor the communication signals received from a printer, determine the printer type (based on the speed of the printer, in the present example), and then respond to and interoperate with the printer in manner desired for that particular printer type.

For other types of printers, the universal cartridge chip 100 may utilize other differences in signaling characteristics to determine the printer type. For example, different printers may transmit signals or data to the universal cartridge chip 100 in different sequences, utilize different voltage levels in the communication signal, read or write data to different locations in the memory 106, read or write data to certain addresses in different orders, transmit different data to the toner cartridge, utilize a different communication protocol and the like. The universal cartridge chip 100 of the present invention may advantageously analyze the signals received from a printer and determine the particular type or family of printer based on the signaling characteristics or contents of the data stream from the printer.

As another example, the Lexmark T620 printer and the Lexmark T630 printer transmit signals to the universal cartridge chip 100 at signal levels of approximately 3.8 volts and 5.0 volts, respectively. The controller 104 of the universal cartridge chip 100 may suitably monitor the voltage levels of the signal received from the printer and determine the printer type based on differences in the voltage levels. The universal cartridge chip 100 will, when the memory 106 is read, return the data expected by a Lexmark T620 printer if the printer is determined to be a Lexmark T620 printer. If the printer is determined by the controller 104 to be a Lexmark T630 printer, the universal cartridge chip will return the data expected by a Lexmark T630 printer. Such data returned to the printer may include programming code, such as a toner loading program (TLP) read from the memory 106 and executed by the printer to calculate the amount of toner remaining in the cartridge. A TLP returned to the T620 will be appropriate for the operation of the T620 printer, and a different TLP returned to the T630 will be appropriate for the operation of the T630 printer. Additionally, after determining the printer type, the controller 104 may instruct the I/O circuitry 102 to select the voltage (or some other physical characteristic, such as voltage or current load, for example) of the signal used to communicate with the printer. In the present example, the controller 104 may direct the I/O circuitry to communicate with the T620 printer utilizing a signal with a high voltage level of 3.8 volts and to communicate with the T630 printer utilizing a signal with a high voltage level of 5.0 volts.

As a further example, while the HP 4200 printer and the HP 1300 printer both transmit an identification number to the universal cartridge chip 100 after a toner cartridge has been installed in the printer, each of these two types of printers transmits a different identification number. The HP 4200 printer transmits "824D73A2" as the identification number and the HP 1300 printer transmits "7B2C50F1" as the identification number. The controller 104 of the universal cartridge chip may suitably monitor this data sent from the printer to determine whether the printer is an HP 4200 printer or an HP 1300 printer. Then, based on the determination of the printer type, the controller 104 will interoperate with the printer in a particular mode of operation.

In one aspect, the universal cartridge chip 100 may utilize a plurality of memory pages in the memory 106 to achieve emulation and interoperability. A first memory page may store the data appropriate for a first type of printer and a second memory page may store the data appropriate for a second type of printer. After making a determination of the type of printer, the controller 104 will direct all memory accesses to the memory page storing the data for that type of printer. In another aspect, the controller 104 may utilize combinatorial logic circuits, programming code, or the like to interoperate with the printer based on the determined printer type. The universal cartridge chip 100 may emulate locked memory locations depending on the type of printer detected. Such a locked memory location may not be successfully written to more than a single time.

In another aspect of the present invention, the universal cartridge chip 100 may interoperate in different ways with different printer types. For example, a first type of printer may utilize a first type of communication protocol when interfacing with the cartridge chip and a second type of printer may utilize a second type of communication protocol differing from the first type of communication protocol. After determining that a printer is the first type of printer, the universal cartridge chip 100 will communicate with that printer utilizing the first type of communication protocol. After determining that a printer is the second type of printer, the universal cartridge chip 100 will communicate with that printer utilizing the second type of communication protocol.

In another aspect of the present invention, the universal cartridge chip 100 may modify a value stored in the memory 106 by the imaging device. For example, the imaging device may utilize a particular area of the memory 106 to store data related to pixel count or the toner remaining in the cartridge. Based on the type of imaging device determined, the universal cartridge chip 100 may modify this area of the memory 106 during the operation of the imaging device to cause the imaging device to believe that the imaging cartridge has a greater or lesser amount of toner than it actually has.

Instead of using a single replaceable cartridge holding both toner and the OPC drum, some imaging devices utilize one replaceable cartridge holding the toner and another replaceable cartridge holding the OPC drum. Each of these imaging cartridges may require a cartridge chip. In one aspect of the present invention, the universal cartridge chip 100 of the present invention may suitably operate in either the cartridge holding toner or the cartridge holding the OPC drum. When installed in or attached to either of these imaging cartridges installed in an imaging device, the universal cartridge chip 100 of the present invention may determine the type or model of the imaging device and the type or model of the imaging cartridge, such as whether the imaging cartridge is a toner cartridge or an OPC drum cartridge. Based on either or both of the determined imaging device type and the determined imaging cartridge type, the universal cartridge chip 100 will operate in a particular mode of operation compatible with the type of imaging device and the type of imaging cartridge. The universal cartridge chip 100 may suitably utilize a variety of techniques, such as the techniques described above, in making the determination of imaging device type and imaging cartridge type. Additionally, the universal cartridge chip 100 may suitably utilize a variety of techniques, such as the techniques described above, in operating in the mode of operation desired for the determined type of imaging device and the determined type of imaging cartridge.

The systems and methods for a universal cartridge chip in accordance with the present invention may be advantageously utilized by cartridge remanufacturers to reduce the number of types of cartridge chips stored in their inventory, improve the efficiency of the remanufacturing process and reduce the likelihood of error during the remanufacturing process.

In another aspect of the present invention, a universal cartridge chip may operate with multiple types or models of printers by utilizing a memory map designed to be compatible with multiple types or models of printers. FIG. 4 shows a memory map 400 which may be utilized by a universal cartridge chip 100 to operate with both the HP 9000 printer and the HP 4100 printer. A universal cartridge chip 100 which returns the data contained in the memory map 400 when data is read from the cartridge chip by the printer will suitably operate with either the HP 9000 printer or the HP 4100 printer. By creating a common memory map, a universal cartridge chip 100 may be utilized with multiple types of imaging devices without the universal cartridge chip 100 making a determination of imaging device type.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. For example, while in a preferred embodiment of the present invention the universal cartridge chip operates with two types of printers, the universal cartridge chip of present invention is not limited to such an embodiment and may be adapted for use with more than two types, models or families of imaging devices. The following claims are in no way intended to limit the scope of the invention to the specific embodiments described herein.

What is claimed is:

1. A method of operating an imaging cartridge installed in an imaging device, the imaging cartridge comprising a cartridge chip, the method comprising:

determining, by the cartridge chip, if the imaging device is a first type of imaging device or a second type of imaging device;

operating the cartridge chip in a first mode of operation if the imaging device is the first type of imaging device; and operating the cartridge chip in a second mode of operation if the imaging device is the second type of imaging device.

2. The method of claim 1 wherein the step of determining further comprises:

monitoring the timing of communication signals received by the cartridge chip from the imaging device; and determining if the imaging device is the first type of imaging device or the second type of imaging device based on the timing of the communication signals.

3. The method of claim 1 wherein the step of determining further comprises:

monitoring the voltage level of communication signals received by the cartridge chip from the imaging device; and determining if the imaging device is the first type of imaging device or the second type of imaging device based on the voltage level of the communication signals.

4. The method of claim 1 wherein the step of determining further comprises:

monitoring the content of communication signals received from the imaging device; and determining if the imaging device is the first type of imaging device or the second type of imaging device based on the content of the communication signals.

5. The method of clam 4 wherein the step of monitoring further comprises:

monitoring one or more particular addresses read from or written to a memory element of the cartridge chip.

6. The method of claim 4 wherein the step of monitoring further comprises:

monitoring an identification number received from the imaging device, said identification number identifying the type of the imaging device.

7. A cartridge chip for use with an imaging cartridge installed in an imaging device, the cartridge chip comprising:

a memory element storing imaging cartridge data; and a controller for controlling the operation of the cartridge chip and determining if the imaging device is a first type of imaging device or a second type of imaging device, said controller for operating the cartridge chip in a first mode of operation if the imaging device is the first type of imaging device, said controller for operating the cartridge chip in a second mode of operation if the imaging device is the second type of imaging device.

8. The cartridge chip of claim 7 wherein the controller is adapted for:

monitoring the timing of communication signals received by the cartridge chip from the imaging device; and determining if the imaging device is the first type of imaging device or the second type of imaging device based on the timing of the communication signals.

9. The cartridge chip of claim 7 wherein the controller is adapted for:

monitoring the voltage level of communication signals received by the cartridge chip from the imaging device; and determining if the imaging device is the first type of imaging device or the second type of imaging device based on the voltage level of the communication signals.

10. The cartridge chip of claim 7 wherein the controller is adapted for:

monitoring the content of communication signals received from the imaging device; and determining if the imaging device is the first type of imaging device or the second type of imaging device based on the content of the communication signals.

11. The cartridge chip of claim 10 wherein the controller is adapted for:

monitoring one or more particular addresses read from or written to a memory element of the cartridge chip.

12. The cartridge chip of claim 10 wherein the controller is adapted for:

monitoring an identification number received from the imaging device, said identification number identifying the type of the imaging device.

13. A computer program embodied on a computer-readable medium for controlling a cartridge chip comprising a memory element for an imaging cartridge comprising:

a determining code segment for determining if an imaging device is a first type of imaging device or a second type of imaging device; and an operating code segment for operating the cartridge chip in a first mode of operation if the imaging device is determined to be the first type of imaging device and operating the cartridge chip in a second mode of operation if the imaging device is determined to be the second type of imaging device.

14. The computer program of claim 13 wherein the determining code segment monitors communication signals received by the cartridge chip from the imaging device to determine if the imaging device is the first type of imaging device or the second type of imaging device.

15. The computer program of claim 14 wherein the determining code segment monitors the timing, voltage level, sequence, protocol or content of the communication signals received by the cartridge chip from the imaging device to determine if the imaging device is the first type of imaging device or the second type of imaging device.

16. A cartridge chip for use with an imaging cartridge installed in an imaging device, the cartridge chip comprising:

a memory element storing imaging cartridge data; and a controller for controlling the operation the cartridge chip and determining if the imaging cartridge is a first type of imaging cartridge or a second type of imaging cartridge, said controller for operating the cartridge chip in a first mode of operation if the imaging cartridge is the first type of imaging cartridge, said controller for operating the cartridge chip in a second mode of operation if the imaging cartridge is the second type of imaging cartridge.

* * * * *